US005991923A

United States Patent [19]

Maria

[11] Patent Number: 5,991,923

[45] Date of Patent: Nov. 30, 1999

[54] TWO-PIECE EASILY ATTACHED AND DETACHED PATIENT GOWN

[76] Inventor: Julie E. Maria, 711 North G St., Oxnard, Calif. 93030

[21] Appl. No.: 09/049,278

[22] Filed: Mar. 27, 1998

[51] Int. Cl.[6] ..... A41B 1/00

[52] U.S. Cl. ..... 2/83; 2/114

[58] Field of Search ..... 2/83, 114, 69, 2/69.5, 104–106, 85, 93, 115, 94

[56] References Cited

U.S. PATENT DOCUMENTS

| | | | |
|---|---|---|---|
| 459,106 | 9/1891 | Fifield | 2/114 |
| 818,351 | 4/1906 | Clark | 2/114 |
| 1,489,046 | 4/1924 | Thompson | 2/114 |
| 2,657,387 | 11/1953 | Ketcham | 2/83 |
| 3,116,491 | 1/1964 | Previdi et al. | 2/105 |
| 3,259,126 | 7/1966 | Greiert | 2/83 |
| 4,142,264 | 3/1979 | Whiting | 2/69.5 X |
| 4,698,848 | 10/1987 | Buckley | 2/114 |
| 4,718,124 | 1/1988 | Sawicki et al. | 2/114 |
| 5,142,702 | 9/1992 | Piloian | 2/102 |
| 5,611,087 | 3/1997 | Adkins | 2/114 |

*Primary Examiner*—Gloria M. Hale
*Attorney, Agent, or Firm*—Albert O. Cota

[57] ABSTRACT

An easily attached and detached patient gown (10) that consists of a back piece (12) and an identical front piece (44). Each of the pieces (12, 44) has attached to its left and right upper sections (16, 18) a left arm section (26) and a right arm section (34). The gown (10) is designed to be placed on a patient by first placing the back piece (12) on a flat surface such as a bed. The patient is then placed upon the back piece (12) and the front piece (44) is placed over the patient and attached to the lower piece (12) by means of complimentary snaps (80). The gown (10) can also be designed to include an implement support pocket (90) that is attached to the inner surface (49) of the front piece (44). Into the pocket (90) is inserted a medical drainage pouch (100). A utility pocket (110) can also be attached to the outer surface (47) of the front piece (44). Into the pocket (110) can be placed various items belonging to the patient. Finally, a front and back leg/feet section (128) can be attached to the lower edges (24, 56) on the back and front pieces (12, 44).

5 Claims, 6 Drawing Sheets

TWO-PIECE EASILY ATTACHED AND DETACHED PATIENT GOWN

TECHNICAL FIELD

The invention pertains to the general field of hospital-type, patient gowns and more particularly to a gown that is comprised of a front section and a rear section. Both gown sections are easily attached when the gown is being put on, are secure when the gown is being worn, and are easily detached when the gown is to be removed.

BACKGROUND ART

There are many different types of apparel for many different functions or situations. A businessman would not wear clothes designed for an athlete due to the fact that each of these types of clothes are specifically designed for a specific purpose. One of the most necessary of the specialized designs of clothes is that of the hospital or patient gown. This type of gown is specifically designed to be worn by patients in a hospital, either during an examination and while resting and recuperating. Also, it can be worn by ambulatory persons who reside at a private residence or a nursing-type home.

The most common style of these gown has a solid front panel with a single rear opening that extends from the neck to the hem and includes rear ties. These gowns must be put on in reverse and usually require that a patient have assistance in tying the rear ties, which are used to keep the gown closed. Unfortunately, the rear opening often becomes un-tied and opens up, thus causing an embarrassment to the person wearing the gown. One reason this occurs is because the inner flap is not supported in its overlapped position, but is allowed to fall towards the center, thereby reducing or eliminating the overlap.

The solid front section of most hospital-type gowns frequency restricts medical access to the front of the patient, particularly to the chest region. Despite many variations in hospital-type gown design, these and other problems have not been successfully overcome. It is therefore readily apparent that some type of hospital gown design, which provides adequate privacy and ease of access to the patients, is necessary.

A search of the prior art did not disclose any patents that read directly on the claims of the instant invention, however the following U.S. patents are considered related:

| U.S. PAT. NO. | INVENTOR | ISSUED |
|---|---|---|
| 4,612,673 | Underhill | 23 September 1986 |
| 3,855,635 | Ramirez | 24 December 1974 |
| D356,204 | Derrickson | 14 March 1995 |

The U.S. Pat. No. 4,612,673 Underhill patent discloses a patient gown having a single body portion, which is enclosed by removably secured fasteners at either the anterior or posterior portion. A V-neck is provided in both the front and the rear, and a pair of shoulder elements are secured to the upper portion of the body, each of which is removably securable at the top so that the entire shoulder can be opened.

The U.S. Pat. No. 3,855,635 Ramirez patent discloses an improved disposable two-piece hospital gown, which is produced from sheets of cloth or paper material. A blouse section is formed of a single sheet of material, initially of rectangular shape that is cut and folded, with adhesive or VELCRO® bands serving to fasten the sides together. The material cut out of the neck section remains attached to the front and serves as a bib. A pants section is formed of two separate sheets of rectangular material that are identically cut and notched, so as to fasten together in the crotch.

The D356,204 Derrickson patent discloses an ornamental design for a hospital gown for a bedridden patient.

The background purposes and as indicative of the art to which the invention is related reference may be made to the remaining cited patents.

| PATENT NO. | INVENTOR | ISSUED |
|---|---|---|
| 5,444,872 | Johnson | 29 August 1995 |
| 5,367,710 | Karmin | 29 November 1994 |
| 5,361,414 | Smith | 8 November 1994 |
| 5,173,965 | Panner | 29 December 1992 |
| 4,951,418 | Marreld, et al | 28 August 1990 |
| 4,718,124 | Sawicki, et al | 12 January 1988 |
| 4,686,715 | Price | 18 August 1987 |
| 4,653,120 | Leaf | 31 March 1987 |
| 4,433,026 | Molde | 21 February 1984 |
| D305,575 | Gordon, et al | 23 January 1990 |

DISCLOSURE OF THE INVENTION

The two-piece, easily attached and detached patient gown allows a patient or a care-provider to put on and remove the gown with far greater ease, comfort and control than conventional gowns. Also, the inventive gown will not come apart or open while it is worn, thus saving a patient from embarrassing situations. Additionally, the design of the gown is amenable for allowing a care-provider to assist a patient in putting the gown on him/her self or when removing the gown.

In its most basic design and function, the gown is comprised of a two pieces: a back piece and a front piece with both pieces having identical dimensions. Because there is no difference in the front and back pieces of the basic design, only the back piece is described.

The back piece of the gown is comprised of a central back section which includes a left upper section and a right upper section, an upper edge and a lower edge. At the upper edge of the gown, between the left and right upper sections, is located a head opening and bordering the left upper section is located a left arm section and bordering the right upper section is located a right arm section. When the back piece and front piece are attached, there lower edges are open. When wearing the gown, the back piece and the front piece including the two arm sections are attached by an attachment means. The attachment means may consist of a pair of complimentary snaps, a hook and loop fastener commonly known by the trademark VELCRO® or a pressure-sensitive double-faced tape may be used when the gown consists of a paper gown that is discarded after use.

To enhance the utility of the patient gown, three elements may be added: a implement support pocket, a utility pocket and/or a leg/feet cover. The implement support pocket which is attached to the inner surface of the front piece is particularly designed to house a medical drainage pouch as typically used for nephrostomy and biliary drainage. The utility pocket is attached to the outer surface of the front piece and is dimensioned to accept several personal items belonging to the patient. The leg/feet cover is detachably attached to the lower edge of the patient gown. The cover is attached when necessary to keep the patient's legs and feet warm.

In view of the above disclosure it is the primary object of the invention to provide a patient gown that can be easily attached and detached.

In addition to the primary object it is also an object of the invention to provide a patient gown that:

can be made to accommodate various human body dimensions, can be made in a sterile white color or in various colors, color combination or patterns, can be made of various materials: for permanent gowns the preferred material is cloth; for throw-away gowns the material is paper, has a long service life, and is cost effective from both consumer and manufacturing points of view.

These and other objects and advantages of the present invention will become apparent from the subsequent detailed description of the preferred embodiment and the appended claims taken in conjunction with the accompanying drawings.

BRIEF DESCRIPTION OF THE DRAWINGS

FIG. 7 also shows a leg/feet cover that is removably attached to the lower edges of the front and back pieces.

BEST MODE FOR CARRYING OUT THE INVENTION

The best mode for carrying out the invention is presented in terms of a preferred embodiment for a two-piece, easily attached and detached patient gown. The two-piece design of this gown allows a patient or a care-provider to put on and remove the gown with far greater comfort and control than other conventional gowns. Also, this gown will not come apart or open while it is worn, thus saving a patient from embarrassing situations.

Figure 1:
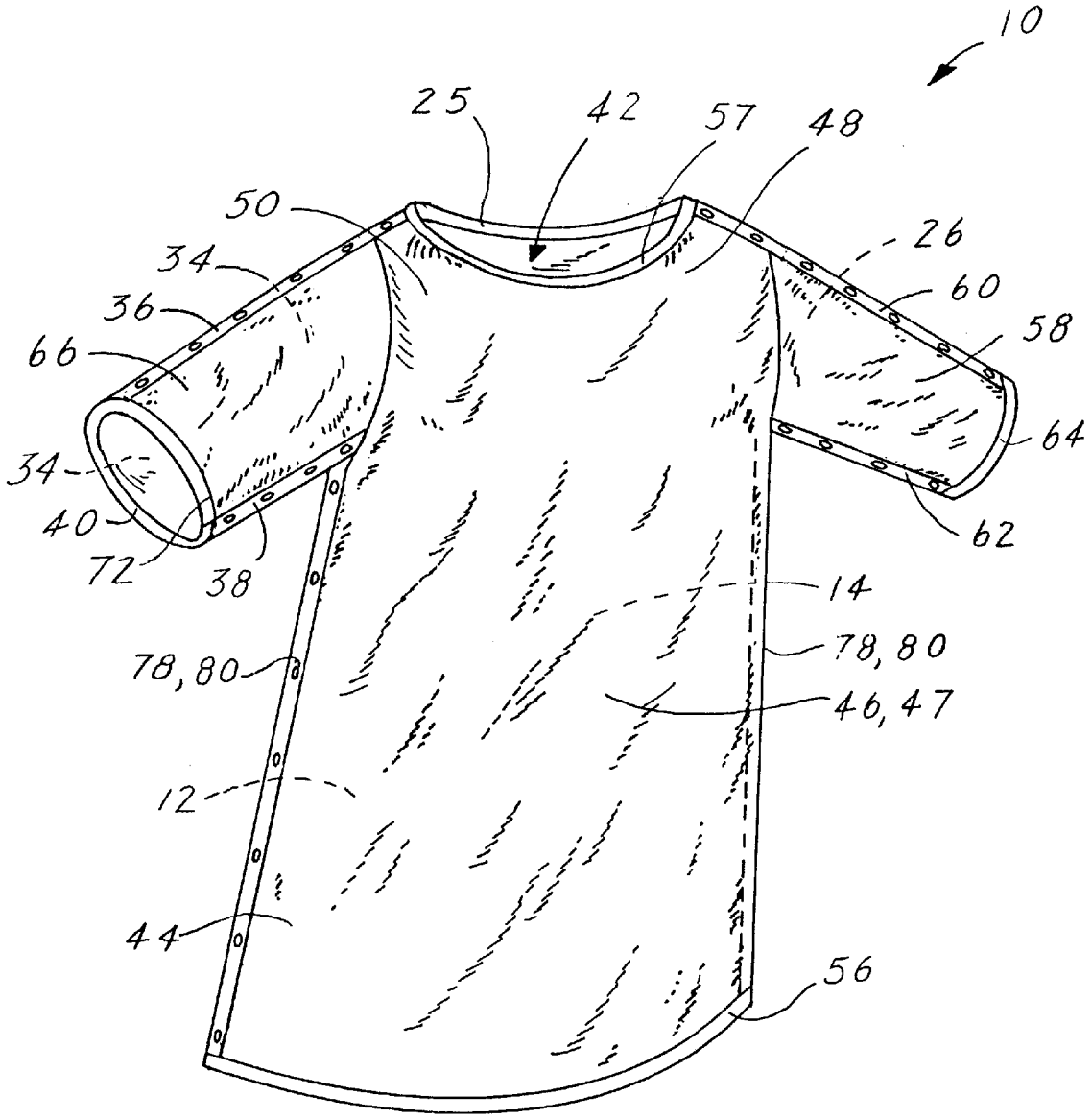
FIG. 1 is a perspective view of the patient gown.

The basic embodiment of the two-piece, easily attached and detached patient gown 10, is shown in FIGS. 1–7 and is comprised of the following major elements: a back piece 12, a back section 14, a left arm section 26, a right arm section 34, a front piece 44, a front section 46, a left arm section 58, a right arm section 66, and an attachment means 78. A perspective view of the basic two-piece gown is shown in FIG. 1.

Figure 8:
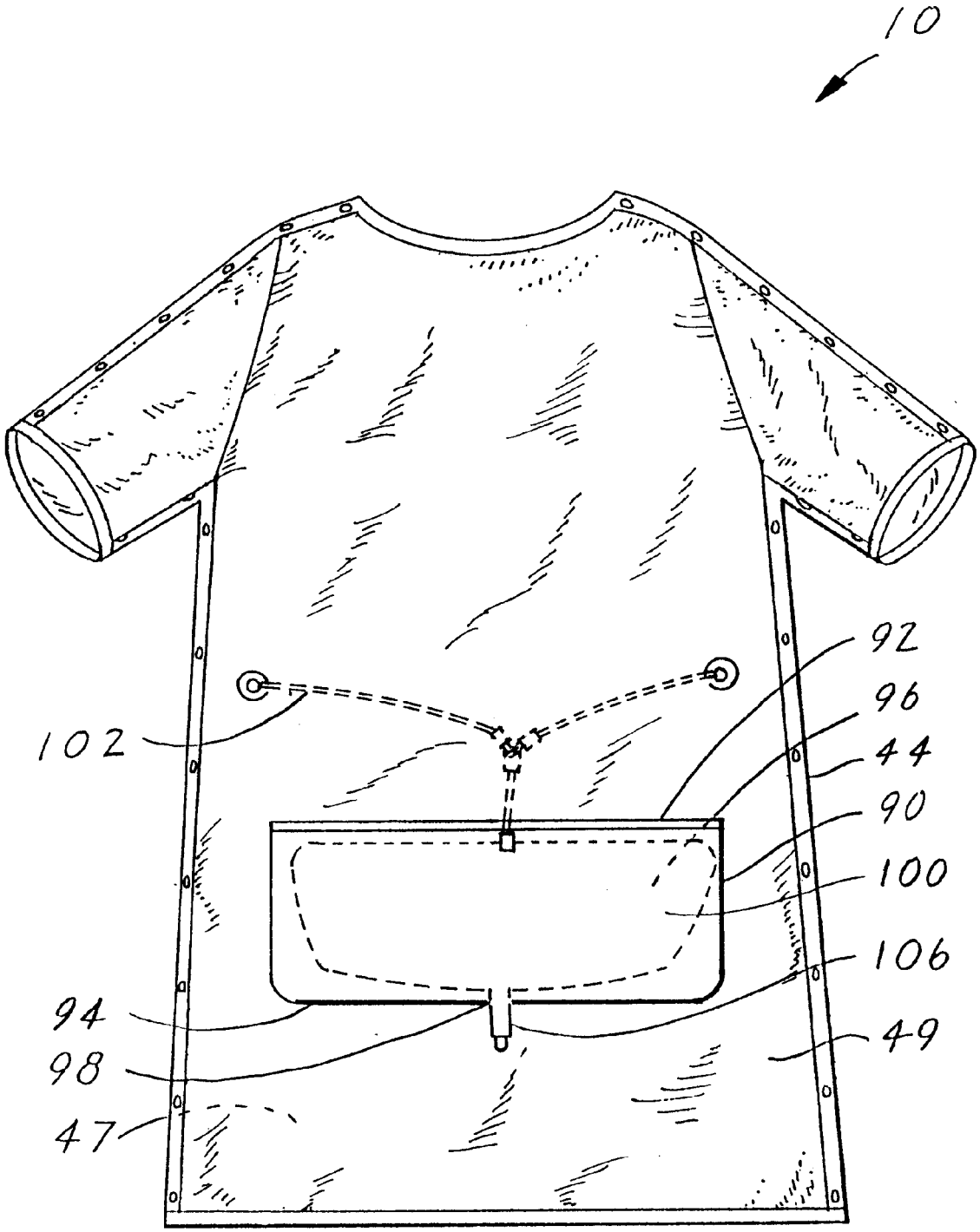
FIG. 8 is an elevational view of the patient gown's front piece which has attached to its inner surface an implement support pocket dimensioned and designed to hold a medical drainage pouch.
Figure 9:
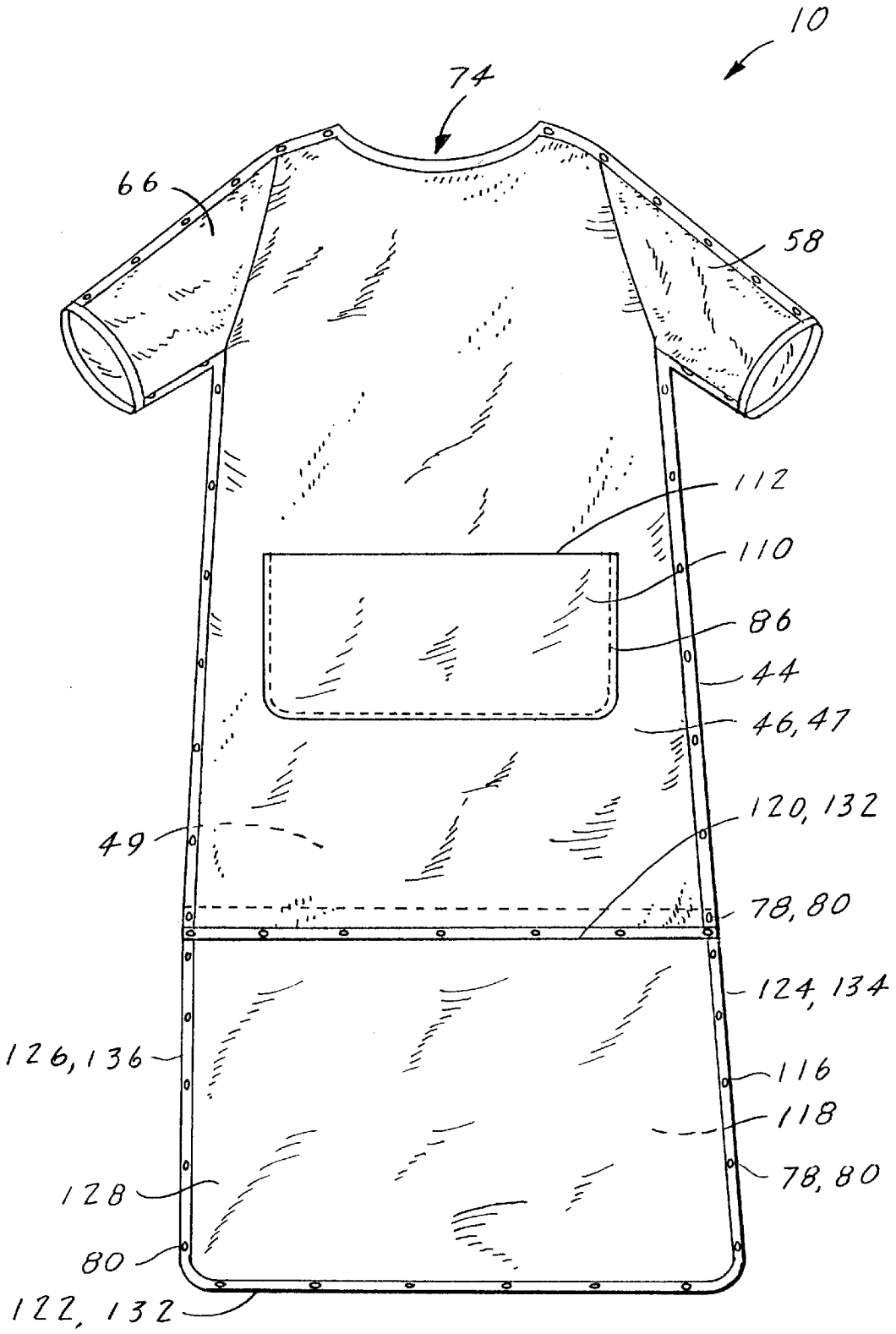
FIG. 9 is an elevational view of a patient gown that has a utility pocket stitched to the outer surface of the gown's front piece.

To increase the utility of the invention, an implement support pocket 90, a utility pocket 110 and a leg/feet cover 116 may be added as shown in FIGS. 8 and 9.

The back piece 12 and the front piece 44 have similar dimensions and can be made of cloth, paper or a plastic with a cloth material such as cotton preferred. The back piece 12 is comprised of the back section 14, the left arm section 26, the right arm section 34, the head opening 42 and the attachment means 78.

Figure 2:
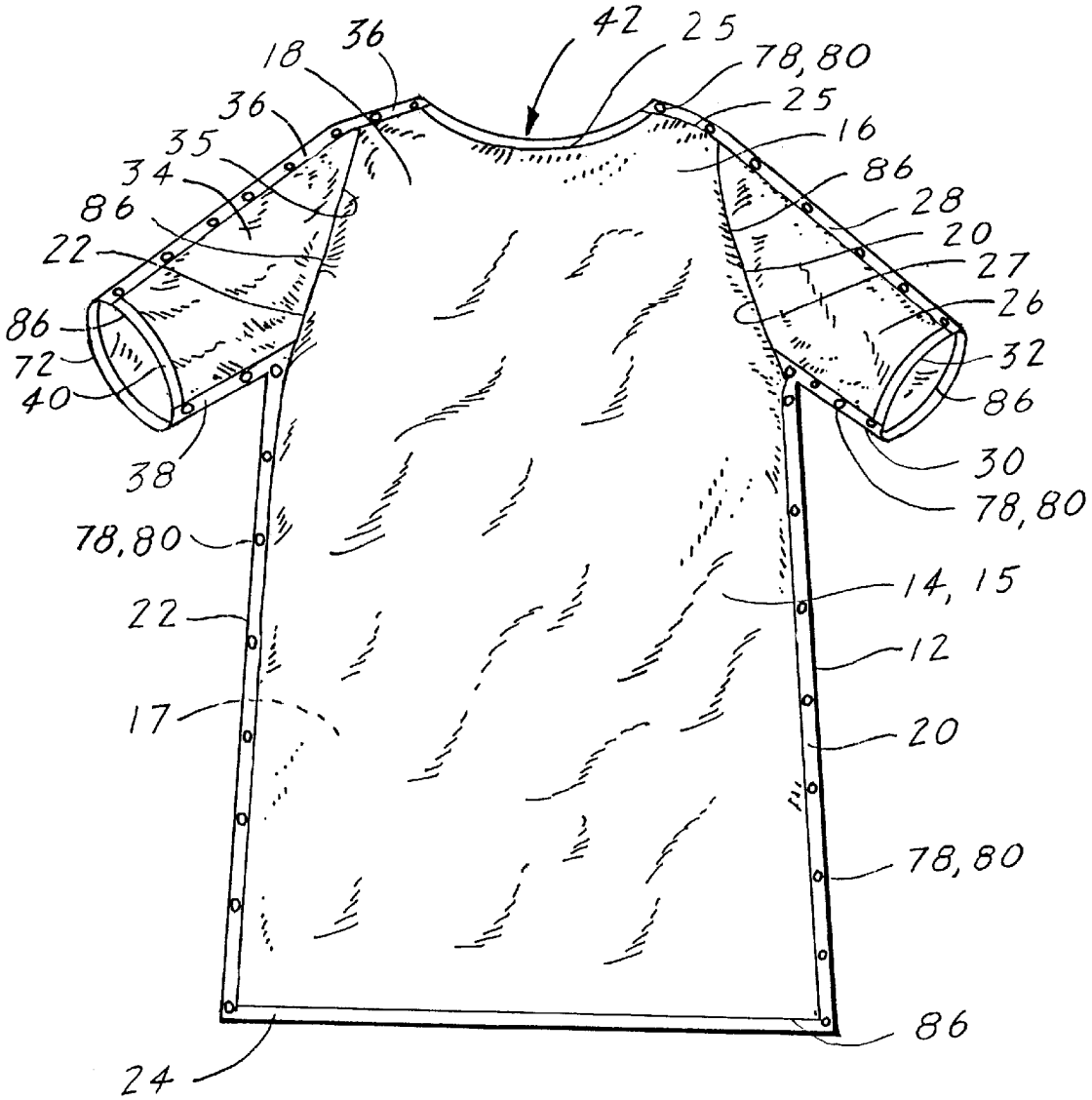
FIG. 2 is an elevational view showing the back piece of the patient gown.
Figure 4:
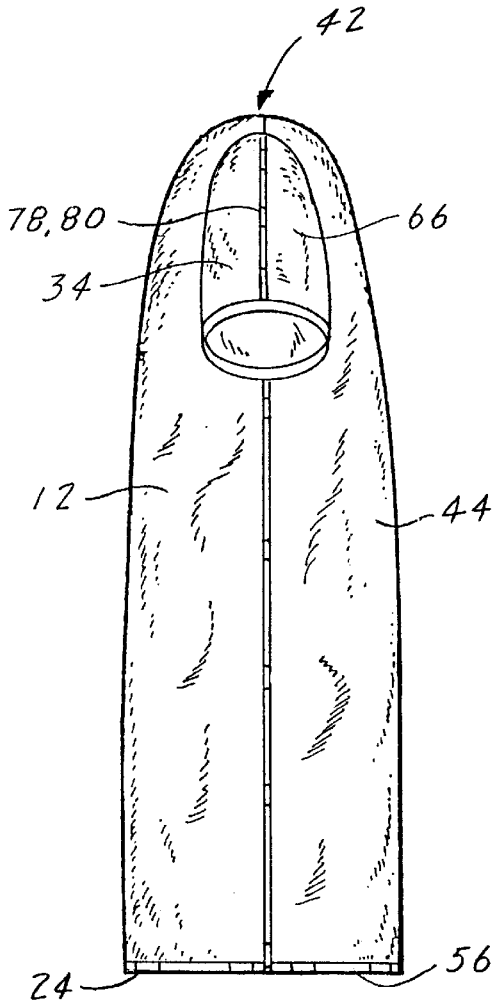
FIG. 4 is a right side elevational view of the patient gown with the back and front pieces attached. The left side view being a mirror image of the right side elevational view.

The back section 14, as shown in FIGS. 2 and 4, has an outer surface 15, an inner surface 17, a left upper section 16, a right upper section 18, a left edge 20, a right edge 22, a lower edge 24 and an upper edge 25. The left arm section 26 includes an inward edge 27 that is attached to the left edge 20 which borders the left upper section 16 of the back section 14. The left arm section 26 further has an upper perimeter section 28, a lower perimeter section 30 and an outward edge 32. The right arm section 34 includes an inward edge 35 that is attached to the right edge 22 which borders the right upper section 18 of the back section 14. The right arm section 34 further has an upper perimeter section 36, a lower perimeter section 38 and an outward edge 40. Along the central upper edge 25 of the back section 14 is the downward and circular head opening 42 as shown in FIG. 2.

Figure 3:
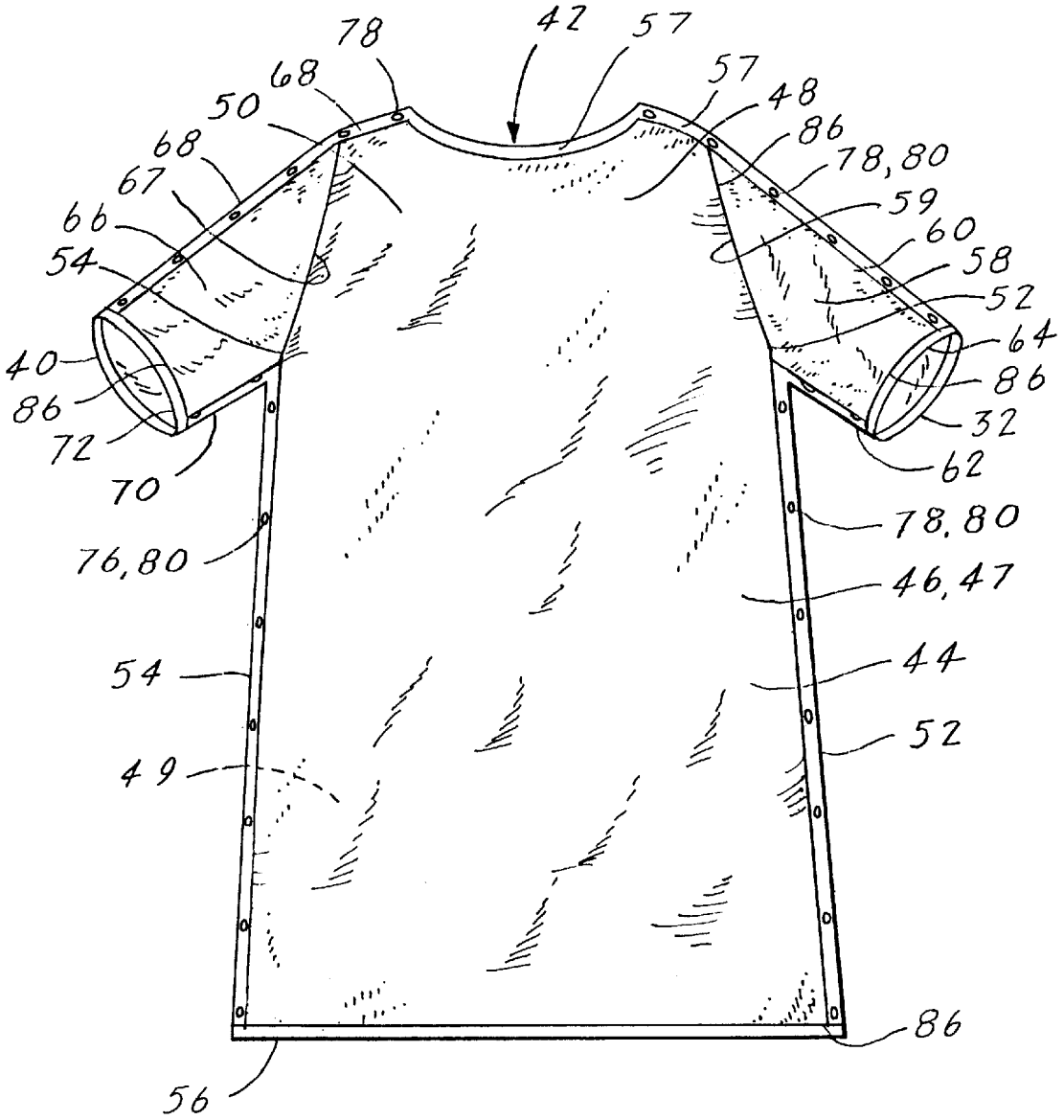
FIG. 3 is an elevational view showing the front piece of the patient gown.

The front piece 44 is comprised of a front section 46, a left arm section 58, a right arm section 66 and a head opening 74. The front section 46, as shown in FIGS. 3 and 4 has an outer surface 47, an inner surface 49, a left upper section 48, a right upper section 50, a left edge 52, a right edge 54, a lower edge 56 and an upper edge 57. The left arm section 58 includes an inward edge 59 that is attached to the left edge 52 which borders the left upper section 48 of the front section 46. The left arm section 58 further has an upper perimeter section 60, a lower perimeter section 62 and an outward edge 64. The right arm section 66 has an inward edge 67 that is attached to the right edge 54 which borders the right upper section 50 of the front section 46. The right arm section 50 further includes an upper perimeter section 68, a lower perimeter section 70 and an outward edge 72. The head opening 42 on the front section 46 is also substantially circular and is centered along the upper edge 57 of the front section 46.

Figure 5:
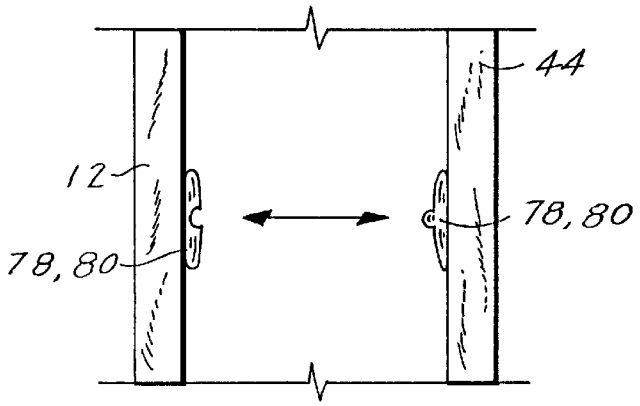
FIG. 5 is a partial elevational view showing a patient gown attachment means consisting of a pair of complimentary snaps.
Figure 6:
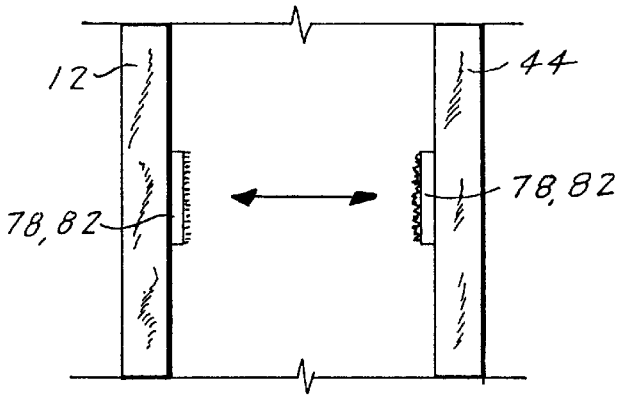
FIG. 6 is a partial elevational view showing a patient gown attachment means consisting of a hook and loop fastener commonly known by the trademark VELCRO®.
Figure 7:
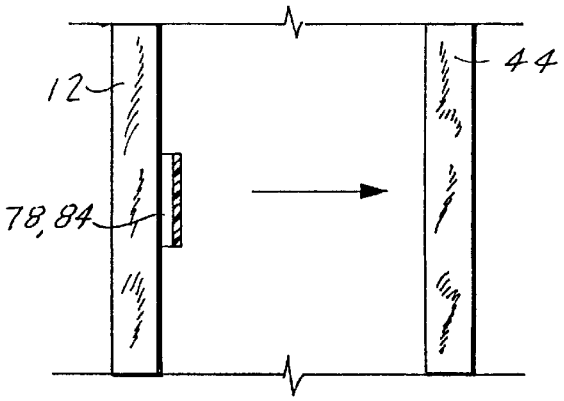
FIG. 7 is a partial elevational view showing a patient gown attachment means consisting of a pressure-sensitive double-faced tape.

The attachment means 78 for easily attaching and detaching the left edges, right edges and the upper edges of the back piece 12 and the front piece 44, and the upper perimeter sections and the lower perimeter sections of the left arm sections and the right arm sections is shown in FIGS. 5, 6 and 7.

The first and preferred attachment means 78 is comprised of a pair of complimentary snaps 80 as shown in FIG. 5. The second attachment means 78 comprises a hook and a loop fastener as shown in FIG. 6. The third attachment means 78 comprises a pair of pressure-sensitive double-faced tape. The third attachment means is particularly suited for gowns 10 that are constructed of a paper material.

The left arm sections 26, 58 and the right arm sections 34, 66 are preferably stitched with thread 86 to the respective back piece 12 and the front piece 44. However, in lieu of the thread stitching 86, the left arm sections and the right arm sections may be cut integral with their respective back piece 12 and the front piece 44. Additionally, to prevent fraying, especially on the cloth gown, the lower edges of the back piece 12 and the front piece 44 are folded over and stitched with thread 86. For the same reason the outward edges 32 and 64 of the left arm sections 26, 58 and the outward edges 40 and 72 of the right arm sections 34, 66 are folded over and stitched with thread 86.

The implement support pocket 90 as shown in FIG. 8 includes an upper edge 92 and a lower edge 94. The pocket 90 extends laterally across the midsection of the inner surface 49 of the front piece 44 and is attached thereto by an attachment means which preferably consists of stitching with thread 86. The upper edge 92 has an opening 96 and the lower edge 94 has a slot 98. The implement support pocket is dimensioned and designed to hold a medical drainage pouch 100 having an upper single or double inlet tube 102 that terminate with a patient connector 104 and a lower drainage tube 106. The drainage tube 106, as shown in FIG. 8, protrudes through the slot 98 on the pocket 90 and the inlet tube 102 extends upward from the opening on the pocket 90. From the pocket 90, the tube 102 is routed and attached to a patient. The pocket 90 and the patient connector 104 can be easily reached via an opening created between a selected pair of attachment means 78 such as a pair of complimentary snaps 80 located between the back piece 12 and the front piece 44. The medical drainage pouch 100 is particularly used for nephrostomy and biliary drainage.

The utility pocket 110, as shown in FIG. 9, includes an upper opening 112 and extends laterally across the midsection of the outer surface 47 of the front piece 44. The utility pocket 110 is attached thereto by an attachment means 78 which preferably consists of stitching with thread 86. The pocket is dimensioned and designed to hold various personal items such as grooming items, letters, pictures and the like.

As also shown in FIG. 9, the gown 10 may be made to include a leg/feet cover 116. This cover 116 or pocket is comprised of a back leg/feet section 118 and a front leg/feet section 128. The back leg/feet section 118 includes an upper edge 120, a lower edge 122, a left edge 124, a right edge 126 and a plurality of complimentary snaps 80 located along each of the edges. The front leg/feet section 128 has similar dimensions as the back leg/feet section. The section 128 also includes an upper edge 130, a lower edge 132, a left edge 134, a right edge 136 and a plurality of complimentary snaps 80 located in alignment with the snaps 80 on the back leg/feet section 118.

To attach the leg/feet cover 116 to the gown 10, as shown in FIG. 9, the lower edges 24 and 56 of the back section 14 and the front section 46 each have a plurality of snaps 80 that are in alignment and compliment the snaps 80 on the upper edges 120, 130 of the back and front leg/feet sections 118,128. When the snaps 80 are pressed together the leg/feet cover 116 is attached to the patient gown 10.

There are various ways by which the gown 10 can be placed on a patient. One way requires that the back piece 12 be initially placed open upon a bed or other flat surface. The patient is then laid face up upon the back piece 12. The front piece 44 is then laid on top of the patient and the two pieces 12, 44 are attached. Conversely, if the patient is required to be in a face down position, the front piece 44 is laid down first, the back piece 12 is then placed on top of the patient and the two pieces are attached. Additionally, a patient may lay on a bed, either face-up or face down, and depending on how the patient is laying, the back piece 12 or the front piece 44 is placed next to the patient, the patient is then rolled onto either the back or front piece and the two pieces 12, 44 are attached.

While the invention has been described in complete detail and pictorially shown in the accompanying drawings it is not to be limited to such details, since many changes and modifications may be made in the invention without departing from the spirit and scope thereof. Hence, it is described to cover any and all modifications and forms which may come within the language and scope of the appended claims.

I claim:

1. A two-piece easily attached and detached patient gown comprising:

a) a back piece having:

(1) a back section having an outer surface, an inner surface, a left upper section, a right upper section, a left edge, a right edge, a lower edge and an upper edge, (2) a left arm section having an inward edge attached to the left edge bordering the left upper section of said back section, said left arm section further having an upper perimeter section, a lower perimeter section and an outward edge, (3) a right arm section having an inward edge attached to the right edge bordering the right upper section of said back section, said right arm section further having an upper perimeter section, a lower perimeter section and an outward edge, (4) a head opening substantially centered, along the upper edge of said back section, b) a front piece having:

(1) a front section having an outer surface, an inner surface, a left upper section, a right upper section, a left edge, a right edge, a lower edge and an upper edge, (2) a left arm section having an inward edge attached to the left edge bordering the left upper section of said front section, said left arm section further having an upper perimeter section, a lower perimeter section and an outward edge, (3) a right arm section having an inward edge attached to the right edge bordering the right upper section of said front section, said right arm section further having an upper perimeter section, a lower perimeter section and an outward edge, (4) a head opening substantially centered along the upper edge of said front section, c) means for easily attaching and detaching the left edges, right edges and the upper edges of said front and back pieces, and the upper perimeter sections and lower perimeter sections of said left and right arm sections, and d) an implement support pocket having an upper edge, and a lower edge wherein said pocket extends laterally across the inner surface of said front piece and is attached thereto by an attachment means, wherein the upper edge having an opening and the lower edge having a slot, wherein said implement support pocket is dimensioned and designed to hold a medical drainage pouch having an upper single or double inlet tube and a lower drainage tube, wherein the drainage tube protrudes through the slot on said pocket and the inlet tube extends upward from the opening on said pocket and is terminated with a patient connector, wherein said pocket and said patient connector is reachable via an opening created between a selected pair of attachment means located between said back piece and said front piece.

2. The patient gown as specified in claim 1 further comprising an implement support pocket having an upper edge, and a lower edge wherein said pocket extends laterally across the inner surface of said front piece and is attached thereto by stitching with thread, wherein the upper edge having an opening and the lower edge having a slot, wherein said implement support pocket is dimensioned and designed to hold a medical drainage pouch having an upper single or double inlet tube and a lower drainage tube, wherein the drainage tube protrudes through the slot on said pocket and the inlet tube extends upward from the opening on said pocket and is terminated with a patient connector, wherein said pocket and said patient connector is reachable via an opening created between a selected pair of attachment means located between said back piece and said front piece.

3. The patient gown as specified in claim 1 further comprising an implement support pocket having an upper edge, and a lower edge wherein said pocket extends laterally across the inner surface of said front piece and is attached thereto by an attachment means, wherein the upper edge having an opening and the lower edge having a slot, wherein said implement support pocket is dimensioned and designed to hold a medical drainage pouch that is particularly used for nephrostomy and biliary drainage wherein said pouch having an upper single or double inlet tube and a lower drainage tube, wherein the drainage tube protrudes through the slot on said pocket and the inlet tube extends upward from the opening on said pocket and is terminated with a patient connector, wherein said pocket and said patient connector is reachable via an opening created between a selected pair of attachment means located between said back piece and said front piece.

4. A two-piece easily attached and detached patient gown comprising:

a) a back piece having:

(1) a back section having an outer surface, an inner surface, a left upper section, a right upper section, a left edge, a right edge, a lower edge and an upper edge, (2) a left arm section having an inward edge attached to the left edge bordering the left upper section of said back section, said left arm section further having an upper perimeter section, a lower perimeter section and an outward edge, (3) a right arm section having an inward edge attached to the right edge bordering the right upper section of said back section, said right arm section further having an upper perimeter section, a lower perimeter section and an outward edge, (4) a head opening substantially centered, along the upper edge of said back section, b) a front piece having:

(1) a front section having an outer surface, an inner surface, a left upper section, a right upper section, a left edge, a right edge, a lower edge and an upper edge, (2) a left arm section having an inward edge attached to the left edge bordering the left upper section of said front section, said left arm section further having an upper perimeter section, a lower perimeter section and an outward edge, (3) a right arm section having an inward edge attached to the right edge bordering the right upper section of said front section, said right arm section further having an upper perimeter section, a lower perimeter section and an outward edge, (4) a head opening substantially centered along the upper edge of said front section, c) means for easily attaching and detaching the left edges, right edges and the upper edges of said front and back pieces, and the upper perimeter sections and lower perimeter sections of said left and right arm sections, d) a leg/feet cover comprising:

(1) a back leg/feet section having an upper edge, a lower edge, a left edge, a right edge and a plurality of snaps located along each of said edges, (2) a front leg/feet section having similar dimensions as said back leg/feet section and also having an upper edge, a lower edge, a left edge, a right edge and a plurality of complimentary snaps located in alignment with the snaps on said back leg/feet section, and (3) said lower edges of said back section and said front section each having a plurality of snaps that are in alignment and compliment the snaps on the upper edges of said back and front leg/feet sections, wherein when the snaps are pressed together said leg/feet cover is attached to said patient gown.

5. A two-piece easily attached and detached patient gown comprising:

a) a back piece having:

(1) a back section having an outer surface, an inner surface, a left upper section, a right upper section, a left edge, a right edge, a lower edge and an upper edge, (2) a left arm section having an inward edge attached to the left edge bordering the left upper section of said back section, said left arm section further having an upper perimeter section, a lower perimeter section and an outward edge, (3) a right arm section having an inward edge attached to the right edge bordering the right upper section of said back section, said right arm section further having an upper perimeter section, a lower perimeter section and an outward edge, (4) a head opening substantially centered, along the upper edge of said back section, b) a front piece having:

(1) a front section having an outer surface, an inner surface, a left upper section, a right upper section, a left edge, a right edge, a lower edge and an upper edge, (2) a left arm section having an inward edge attached to the left edge bordering the left upper section of said front section, said left arm section further having an upper perimeter section, a lower perimeter section and an outward edge, (3) a right arm section having an inward edge attached to the right edge bordering the right upper section of said front section, said right arm section further having an upper perimeter section, a lower perimeter section and an outward edge, (4) a head opening substantially centered along the upper edge of said front section, and c) a pair of complimentary snaps for easily attaching and detaching the left edges, right edges and the upper edges of said front and back pieces, and the upper perimeter sections and lower perimeter sections of said left and right arm sections.

* * * * *